US006116153A

United States Patent [19]

Burrows

[11] Patent Number: 6,116,153

[45] Date of Patent: Sep. 12, 2000

[54] BAKING RACK

[76] Inventor: Harlow Bert Burrows, 6260-28 Ave, Delta, Canada, V4L 2N6

[21] Appl. No.: 09/439,272

[22] Filed: Nov. 12, 1999

[51] Int. Cl.[7] ..... A47S 43/18

[52] U.S. Cl. ..... 99/426; 99/448; 99/450

[58] Field of Search ..... 99/426, 448, 449, 99/450, 416, 417; 211/184, 181.1, 183.2

[56] References Cited

U.S. PATENT DOCUMENTS 2,475,964 7/1949 Hughey ..... 99/426 X
4,559,869 12/1985 Hogan ..... 99/426
5,562,023 10/1996 Harrison ..... 99/426

*Primary Examiner*—Reginald L. Alexander

[57] ABSTRACT

A non-adjustable baking rack designed to support a plurality of different rigid and soft foods; ie: steak, chicken, spare ribs, sausages, thin food items and others, having one vertical rack at the front of the structure attached to a main base support rack, followed by a series of equally spaced racks extending upward at an angle from the main base support rack. Such angled racks slope towards the rear of the structure. This baking rack must be used with a cookie sheet (not supplied) to catch fat drippings from food during the cooking process. The main support rack is in an elevated position to the cookie sheet.

1 Claim, 2 Drawing Sheets

PROPOSED BAKING RACK
SIDE VIEW

PROPOSED BAKING RACK

FRONT VIEW

PROPOSED BAKING RACK
SIDE VIEW

BAKING RACK

DESCRIPTION OF THE PRIOR ART

Numerous devices of this type, the separating, raising, and cooking of food products on a barbeque or in an oven have been designed in the past.

Example: U.S. Pat. No. 4,559,869, adjustable barbeque rack discloses vertical upright dividers of which some are adjustable. This type of device works only for rigid food products.

Example: U.S. Pat. No. 5,562,023, describes a rib rack with sauce pan to hold a large volume of ribs in a total upright position.

Example: U.S. Pat. No. 5,638,809, collapsible, multilevel baking rack comprising of two horizontal baking racks stacked one on top of the other with a space in between.

Example: U.S. Pat. No. 5,069,117, multi-purpose poultry roaster and baking rack describes a plurality of vertical wires or skewers attached to a base in a drip pan designed to hold poultry or other rigid food items, vertically.

These devises appear to fulfill their respective objectives, however, these patents do not describe a raised baking rack with a plurality of partitions, secured to a main support base, sloped to allow the cooking of soft food products—thin strips of steak (minute steaks) de-boned chicken breast, thin cuts of fish, thin veal cutlets, etc.

Vertical partitions only allow the cooking of firm food products and horizontally stacked baking racks will allow fat from the upper rack of food items to drip down and collect on the lower rack food items.

SUMMARY OF INVENTION

A non adjustable wire baking rack for the cooking of rigid and soft food products where the food items are supported by a plurality of sloping wire partitions which are in-turn secured to a main support base which base is elevated within a shallow pan or on a cookie sheet.

DESCRIPTION OF THE PREFERRED EMBODIMENT

Figure 1:
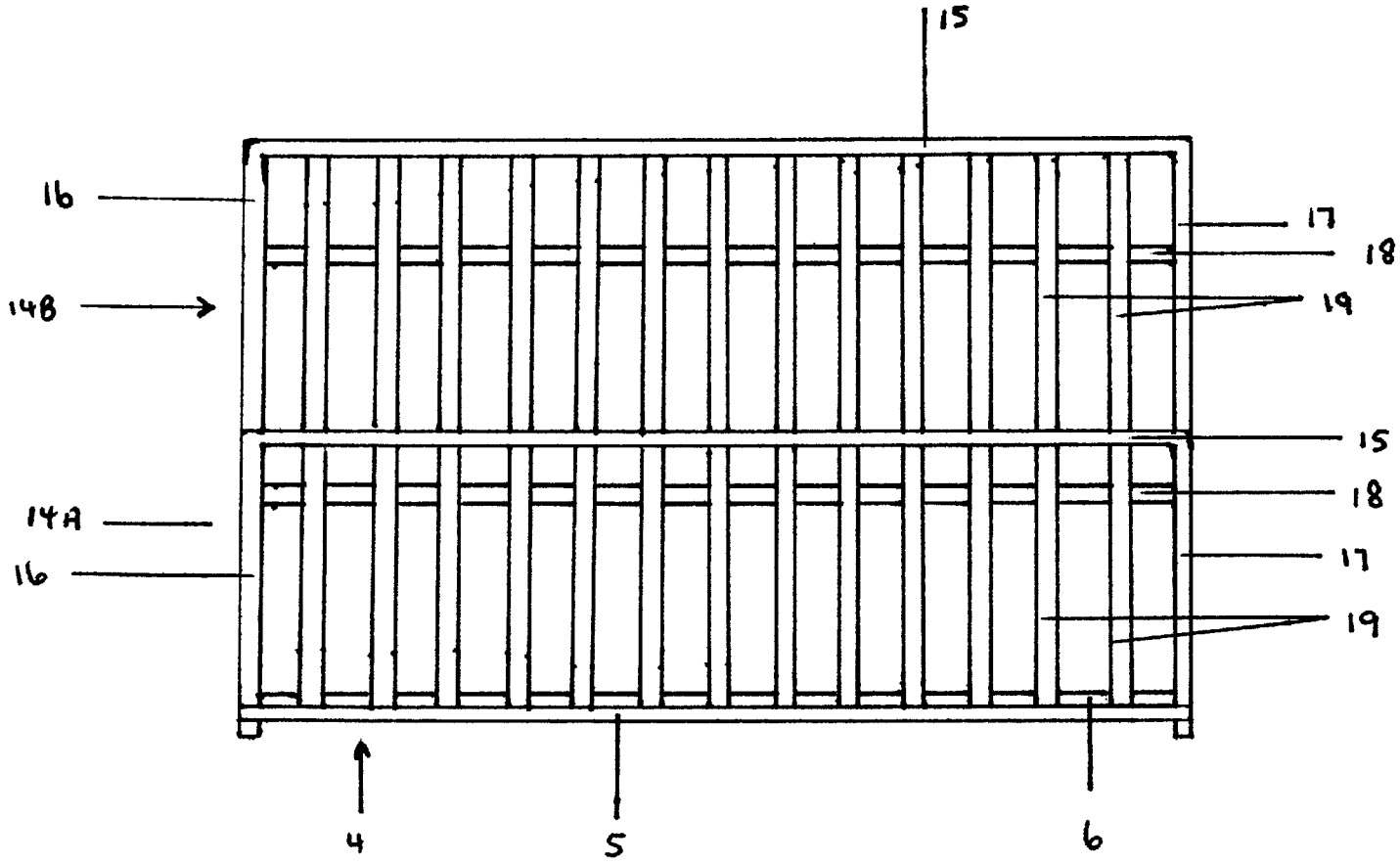
FIG. 1. is a front end view of the baking rack.
Figure 2:
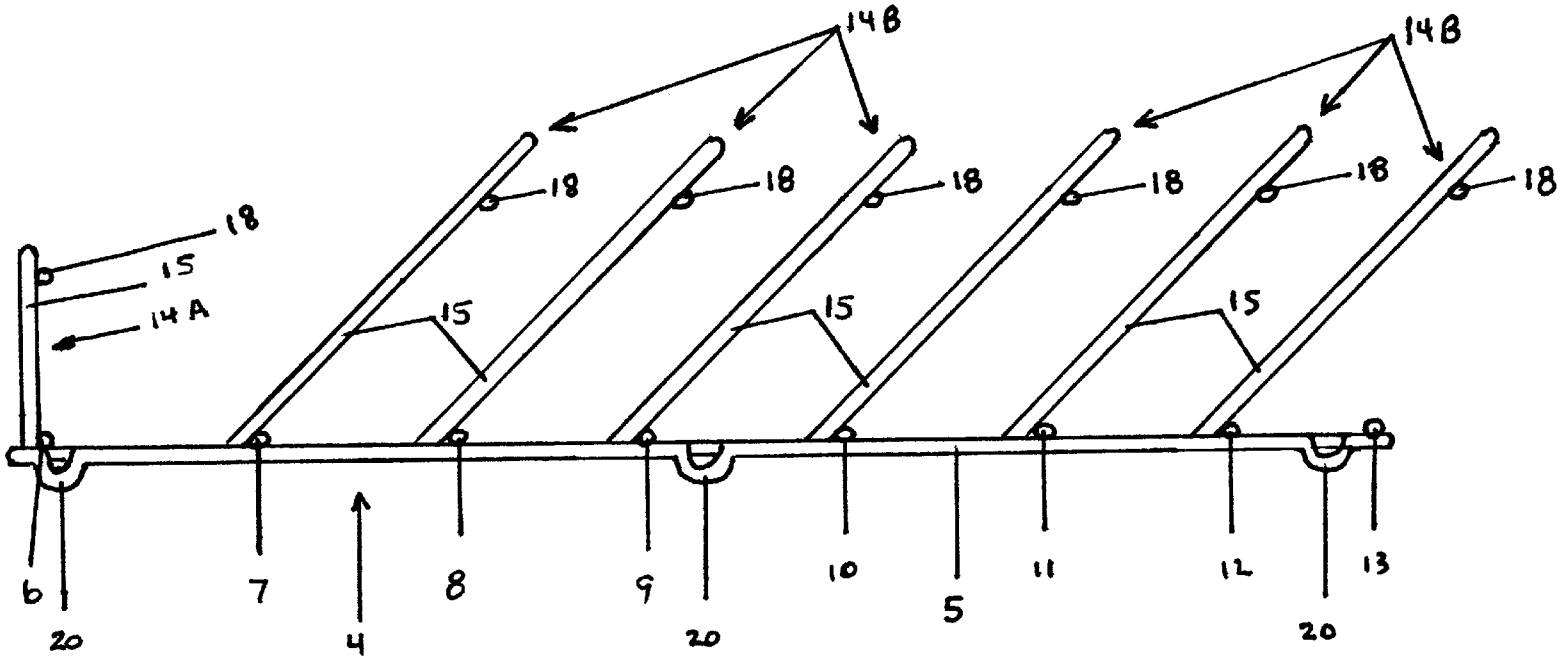
FIG. 2. is a side view of the baking rack.

A non adjustable baking rack for the oven cooking of rigid and non rigid food items made of a main support base, 4, FIGS. 1 & 2, which support base is a continuous wire rod bent as to defining a generally rectangular rack configuration, 5, to which is secured a plurality of closely evenly spaced, wire rods, running lengthwise in the rectangular configuration and attached to the continuous wire rod by welding. To ensure a strong integral structure, transversely positioned wire rods 6 through 13, FIG. 2, rest on the rectangular configuration and wire rods running lengthwise and are welded at all points of contact.

Referring now to the raised partitions, FIGS. 1 & 2, there can be seen a spaced plurality of upstanding partitions, 14A & 14B each having a main support frame, 15 , with oppositely disposed, down turned parallel end members, 16 & 17, FIG. 1, to which is secured a plurality of closely, evenly spaced wire rods running vertically, FIG. 1, 19, all of which are secured to the main support base 4 and partitions main support frame 15 by welding. A cross support rod, 18. is secured by welding to the partitions, 14A & 14B, in a manner as best seen in FIG. 1 & FIG. 2.

Referring to FIG. 2, partition 14A, which is shorter than partition 14B, is in a 90 degree position to the main support base,4, and partitions 14B are in a less than 90 degree position to the main support base, such slope being towards the rear of the baking rack.

Referring to FIG. 2, the main support base, 4, which is a continuous wire rod, bent as to define a general rectangle, has 6 depressions downward, 20, three depressions on either side of the baking rack main support base, which constitute feet thus effectively elevating the main support base which would be positioned on a cookie sheet or similar shallow pan.

It can be seen that a more versatile and useful baking rack has been illustrated and described to the extent that soft foods, (boneless chicken breasts, thin hammered out wiener schnitzel, bacon strips, and other similar soft food products) would rest on the sloped surface rather than drop to the bottom of the baking rack if the partitions had been in an upright position to the main support base. As is apparent from this description, if the food products were to fall to the bottom of the baking rack, uniform cooking would not be possible.

The embodiments of the invention in which an exclusive property or privilege is claimed are defined as follows:

1. A non adjustable baking rack for cooking a variety of soft and rigid food products having a main support base consisting of elongated evenly spaced base wire support rods, a plurality of cross support wires secured to said elongated wire support rods, a vertical 90 degree upright partition at the front of the baking rack, followed by a plurality of evenly spaced, aligned upstanding partitions which are sloped towards the rear of the baking rack and carried by the main support base, said upstanding partitions, having a main support frame of evenly spaced wire rods with a plurality of cross support wire rods, secured thereto, to give integrity to the said upstanding partitions and said main support base, upon which upstanding partitions are secured said non-adjustable baking rack being elevated due to 6 depressions on the main support base frame forming 6 feet which allows the baking rack to be used in our elevated position when used on a typical cookie sheet.

* * * * *